US007752874B2

(12) United States Patent
Foti

(10) Patent No.: US 7,752,874 B2
(45) Date of Patent: Jul. 13, 2010

(54) LOCK

(75) Inventor: Ivan Foti, c/o MGX Asia Limited RM 1307 Boss Commerical Centre 28 Ferry Street, Yau Ma Tai, Kowloon (HK)

(73) Assignee: Ivan Foti, Kowloon (HK)

( * ) Notice: Subject to any disclaimer, the term of this patent is extended or adjusted under 35 U.S.C. 154(b) by 441 days.

(21) Appl. No.: 11/575,235

(22) PCT Filed: Sep. 2, 2005

(86) PCT No.: PCT/GB2005/003396

§ 371 (c)(1),
(2), (4) Date: Aug. 30, 2007

(87) PCT Pub. No.: WO2006/030177

PCT Pub. Date: Mar. 23, 2006

(65) Prior Publication Data

US 2008/0053172 A1 Mar. 6, 2008

(30) Foreign Application Priority Data

Sep. 14, 2004 (GB) ..... 0420471.5

(51) Int. Cl.
*E05B 67/36* (2006.01)

(52) U.S. Cl. ..... 70/33; 70/277; 70/278.7; 70/283.1; 70/369; 70/371; 70/DIG. 49

(58) Field of Classification Search ..... 70/32–34, 70/371, DIG. 49, 51, 451, 367–370, 279.1, 70/283.1, 278.2, 278.3, 278.7, 277
See application file for complete search history.

(56) References Cited

U.S. PATENT DOCUMENTS 1,853,162 A * 4/1932 Jacobi ..... 70/260
2,104,981 A * 1/1938 Falk ..... 70/33
3,386,272 A * 6/1968 Schwartz ..... 70/81
3,422,643 A * 1/1969 Foote ..... 70/38 B
4,556,872 A 12/1985 Masoncup et al.
4,672,828 A * 6/1987 Theriault ..... 70/373
4,811,578 A * 3/1989 Masoncup et al. ..... 70/38 B
5,291,761 A * 3/1994 Lii ..... 70/18
5,363,678 A 11/1994 Meckbach
5,377,511 A * 1/1995 Meckbach ..... 70/38 A
5,394,711 A * 3/1995 Pitkanen ..... 70/38 A
5,442,941 A * 8/1995 Kahonen et al. ..... 70/34
5,507,160 A * 4/1996 Shieh ..... 70/233
5,653,131 A * 8/1997 Shibata et al. ..... 70/185

(Continued)

FOREIGN PATENT DOCUMENTS

DE 9419272 U1 1/1995

(Continued)

*Primary Examiner*—Lloyd A Gall
(74) *Attorney, Agent, or Firm*—The Ollila Law Group LLC

(57) ABSTRACT

A lock is provided with an electronics module (30) by forming the lock with a body (10) and a separate unit (18). The unit (18) includes a locking mechanism (23) and is inserted and removed from the lock body (10), removal allowing easy access to the electronics module (30) without requiring a separate access. This gives increased security. The locking mechanism (23), electronics module (30) and body (10) can be replaced with compatible components.

21 Claims, 4 Drawing Sheets

U.S. PATENT DOCUMENTS

| | | | | |
|---|---|---|---|---|
| 5,727,405 | A * | 3/1998 | Cromwell | 70/38 B |
| 5,736,924 | A | 4/1998 | Shieh | |
| 5,848,540 | A * | 12/1998 | Pieper | 70/252 |
| 6,047,575 | A | 4/2000 | Larson et al. | |
| 6,708,534 | B1 | 3/2004 | Ruan | |
| 6,761,051 | B1 | 7/2004 | Tsai | |
| 7,076,976 | B1 * | 7/2006 | Goldman | 70/33 |
| 7,316,140 | B2 * | 1/2008 | Russell et al. | 70/278.3 |

FOREIGN PATENT DOCUMENTS

| | | | |
|---|---|---|---|
| DE | 29500313 | U1 | 3/1995 |
| DE | 4430377 | A1 | 2/1996 |
| DE | 29609609 | U1 | 9/1996 |
| EP | 0189147 | A | 7/1986 |
| GB | 2190421 | A | 11/1987 |
| GB | 2224071 | A | 4/1990 |
| GB | 2224771 | A | 5/1990 |
| GB | 2276412 | A | 9/1994 |

* cited by examiner

LOCK

RELATED APPLICATIONS

This is a National Stage entry of International Application No. PCT/GB2005/003396, with an international filing date of Sep. 2, 2005, which claims priority of Great Britain patent application no. 0420471.5, filed Sep. 14, 2004.

BACKGROUND TO THE INVENTION

1. Field of the Invention

The invention relates to locks.

2. Brief Description of the Prior Art

A known lock comprises a body, a locking member moveable relative to the body between locked and unlocked positions and a locking mechanism operable to lock the locking member in the locked position and release the locking member for movement to the unlocked position. It is known to incorporate in such locks electrical equipment such as, for example, an alarm that operates when an attempt is made to tamper with the lock. The alarm is usually housed separately in the body together with a power source and it may be accessed through an access door for maintenance and battery replacement. This requires the lock to be adapted to accept the electrical equipment and also requires tools to remove and replace it. Each lock must be adapted separately to contain the electronics.

According to the invention, there is provided a lock comprising a body, a locking member movable relative to the body into and away from a locked position, a mechanical locking unit engaged with the body and lockable to lock the locking member in the locked position and unlockable to release the locking member for movement away from said locked position, a cavity leading into the body and a sub-unit located in the cavity, the sub-unit including a power source and a system powered by the source, the locking unit closing said cavity when engaged with the body and, when said locking member is unlocked, being disengageable from the body.

The sub-unit can be accessed following disengagement of the locking unit. By including the power source and powered system in the sub-unit, these can be accessed for maintenance and replacement and/or operation.

The following is a more detailed description of two embodiments of the invention, by way of example, reference being made to the accompanying drawings in which:

DESCRIPTION PF THE PREFERRED EMBODIMENTS

Figure 1:
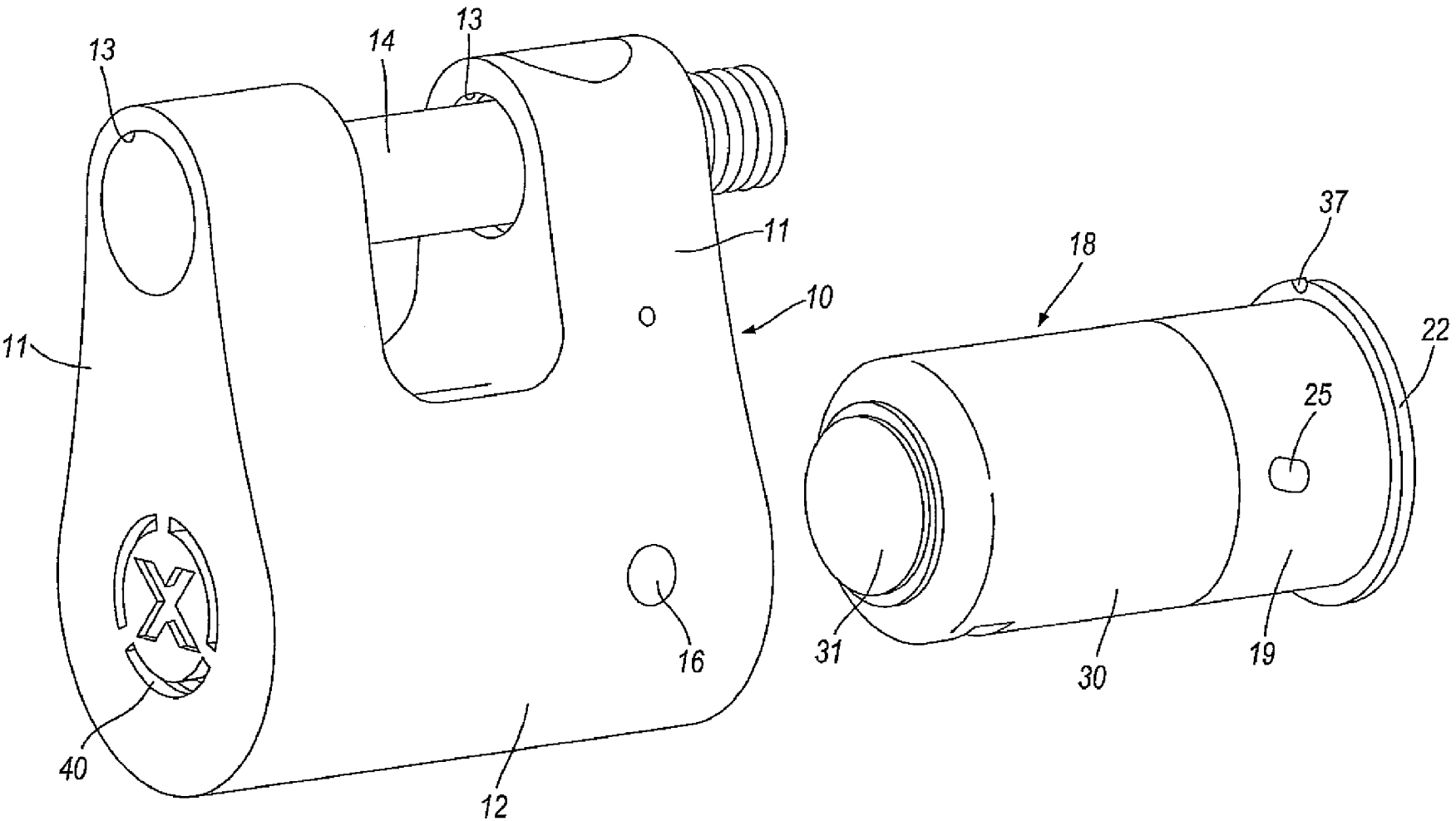
FIG. 1 is a perspective view of a lock including a body and a removable unit separated from the body.
Figure 2:
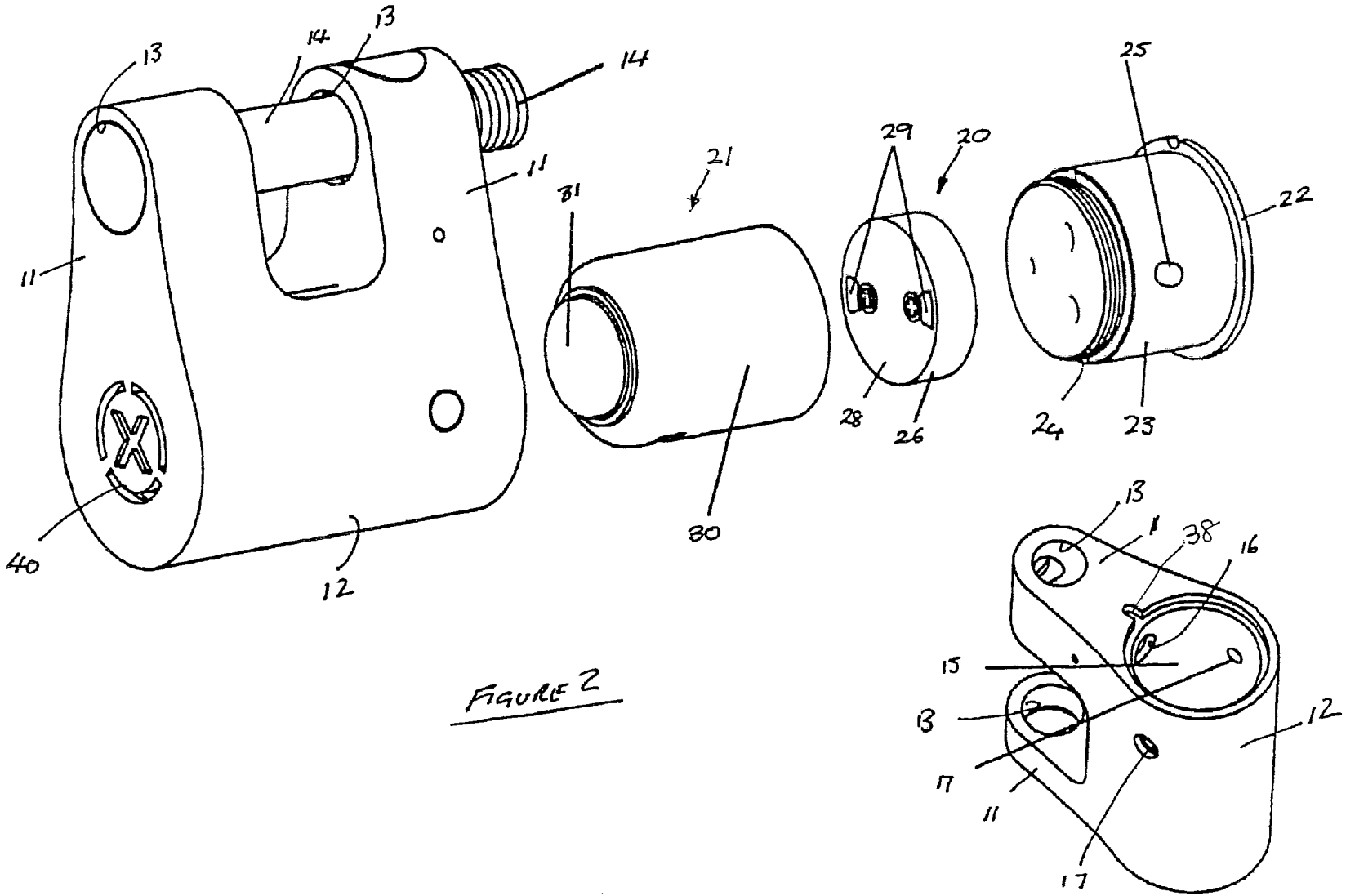
FIG. 2 is a similar view to FIG. 1 but showing the unit exploded and showing the view of the body from above and one side.
Figure 3:
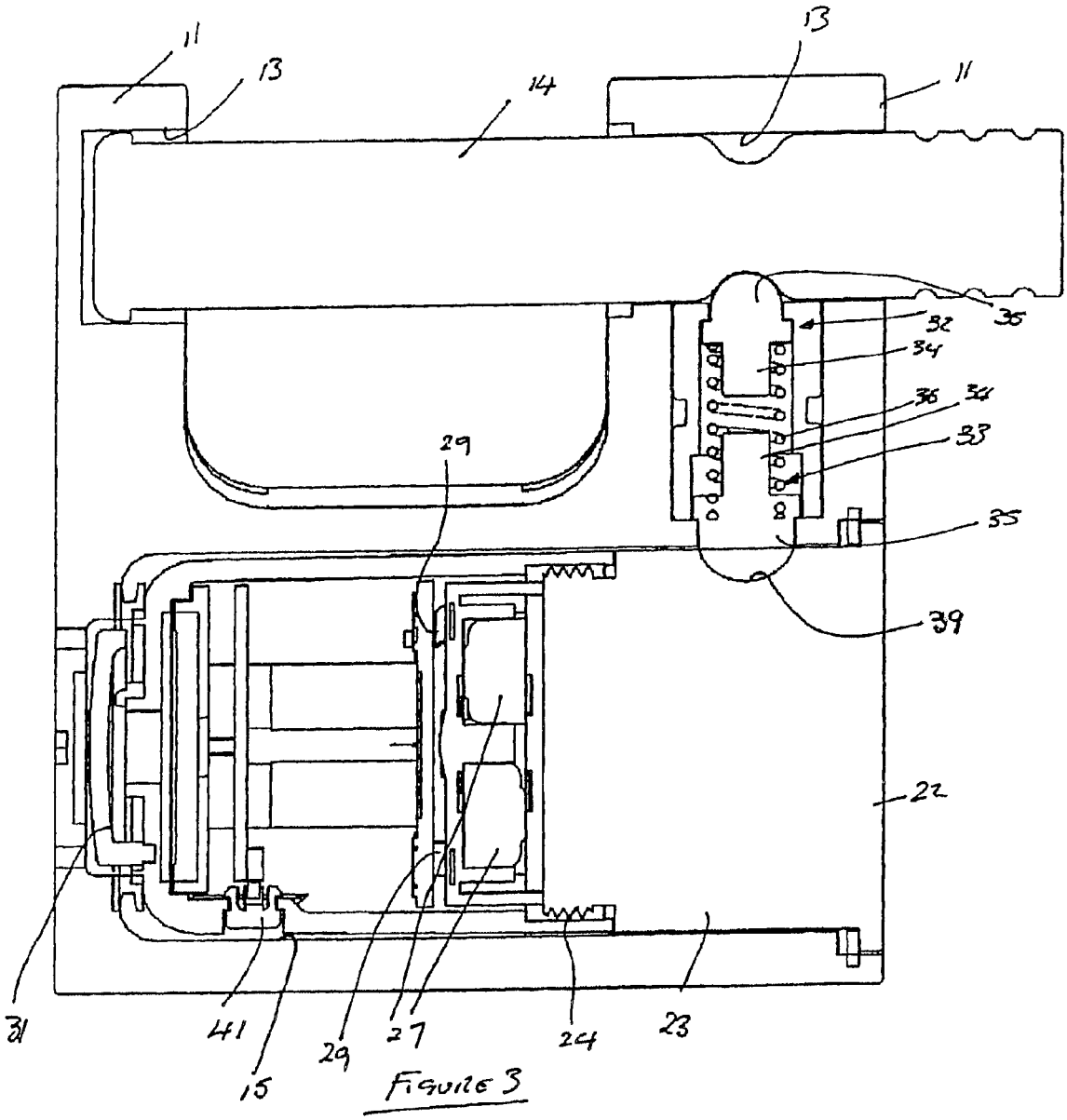
FIG. 3 is a cross-section of the lock of FIG. 1 and with the locking member of the lock in a locked position and the unit located in the body.

Referring first to FIG. 1, the lock of FIGS. 1 to 3 is formed by a body indicated generally at 10 having a pair of arms 11 interconnected by a barrel 12. The arms 11 and the barrel 12 are formed in one-piece from, for example, steel. Each arm is provided with a respective hole 13 and the two holes 13 are coaxial. A bolt 14, in the shape of a rod, extends through the holes 13 to span the gap between the arms 11.

As seen in FIGS. 2 and 3, the interior of the barrel 12 is formed with a cylindrical bore 15 forming a cavity open at one end and closed at the other end. The bore 15 has an axis that is parallel to the common axis of the holes 13. Towards the open end, the bore 15 is provided with a passage 16 extending radially from the bore 15 through the body 10 to emerge radially in the adjacent hole 13. A pair of diametrically-opposed spaced locking holes 17 are also provided extending radially from the bore 15 at a position spaced angularly by 90° from the passage 16. The function of the passage 16 and the holes 17 will be described below.

A removable unit 18 is located in the bore 15 and is formed in three parts; a locking unit 19 and a sub-unit formed by a battery compartment 20 and an electronics module 21. The locking unit 19 is formed by a circular end plate 22 carrying a cylindrical housing 23. The end of the housing 23 remote from the plate 22 is provided with a circumferential thread 24. The housing 23 contains a lock mechanism (not shown) operated by a key (not shown) inserted through the end plate 22. Operation of the key in one sense extends a pair of radially extending locking pins out of the housing 23.

The locking pins are located on diametrically opposite sides of the housing 23 and one locking pin is shown at 25.

The battery compartment 20 also comprises a cylindrical housing 26 containing two batteries 27 (see FIG. 3). The housing has an end surface 28 carrying two battery contacts 29.

The electronics module 21 also comprises a cylindrical housing 30 closed at one end and open at the opposite end where the housing 30 is provided with a thread (not shown) for threaded engagement with the thread 24 on the locking portion 19. The battery compartment 20 fits into the open end of the electronics module housing 30 and provides power for electronics within the module 21.

In the examples shown in FIGS. 1 to 3, the electronics module 21 contains an alarm system (not shown) but it will be appreciated that the module may include any electronic device such as a radio transmitter, a data logging system, a diagnostic system or a sensor for sensing light or gas for example. The alarm system includes a movement sensor (not shown) and a siren 31 located at the closed end of the electronics module housing 30.

The passage 16 contains two oppositely directed catches 32, 33. Each catch is formed by a stem 34 carrying a respective semi-spherical head 35. Each stem 34 is inserted into a respective end of a coil spring 36 with one end of the coil spring 36 engaging behind one head 35 and the other end of the coil spring 36 engaging behind the other head 35 to urge the catches 32, 33 out of respective opposite ends of the passage 16.

The lock operates as follows.

The locking bolt 14 is inserted through the arms 11 with the unit 18 removed from the bore 15 in the barrel 12 into a locking position. This is the position shown in FIG. 1. The unit 18 is then inserted into the bore 15 with a notch 37 on the end plate 22 registering with a notch 38 at the end of the bore 15 to align the unit 18 in the bore 15. A key (not shown) is then inserted through the end plate 22 into the lock 19 and turned to extend the locking pins 25. As a result, the locking pins 25 enter the holes 17 to lock the unit 18 to the body 10 and thus close the bore 15.

As the unit 18 is inserted into the bore 15, the catch 33 is forced upwardly to compress the coil spring 36 and force the catch 32 into a recess 39 on the locking member 14. This locks the locking member 14 to the body 10. Accordingly, the locking member 14 cannot be removed. If an attempt is made to tamper with the lock, it is sensed by the electronic module 21 and the siren 31 is sounded. The closed end of the bore 15 is provided with shaped apertures 40 to allow the sound to exit.

In order to release the locking member 14, the key is again inserted through the end plate 22 into the lock 19 and turned to retract the locking pins 25 into the lock 19. This allows the unit 18 to be removed from the bore 15 which in turn releases the catches 32, 33 thus allowing the locking bolt 14 to be removed.

It will be appreciated that, since the battery compartment 20 forms part of the sub-unit which is part of the unit 18, the battery compartment 20 is removed with the unit 18. The batteries 27 can therefore be easily and conveniently replaced. In addition, maintenance of the electronics module 21 is easy and convenient. Further, as seen in FIG. 3, the electronics module 21 is provided with a switch 41 to allow the alarm to be switched on and off as required.

Figure 4:
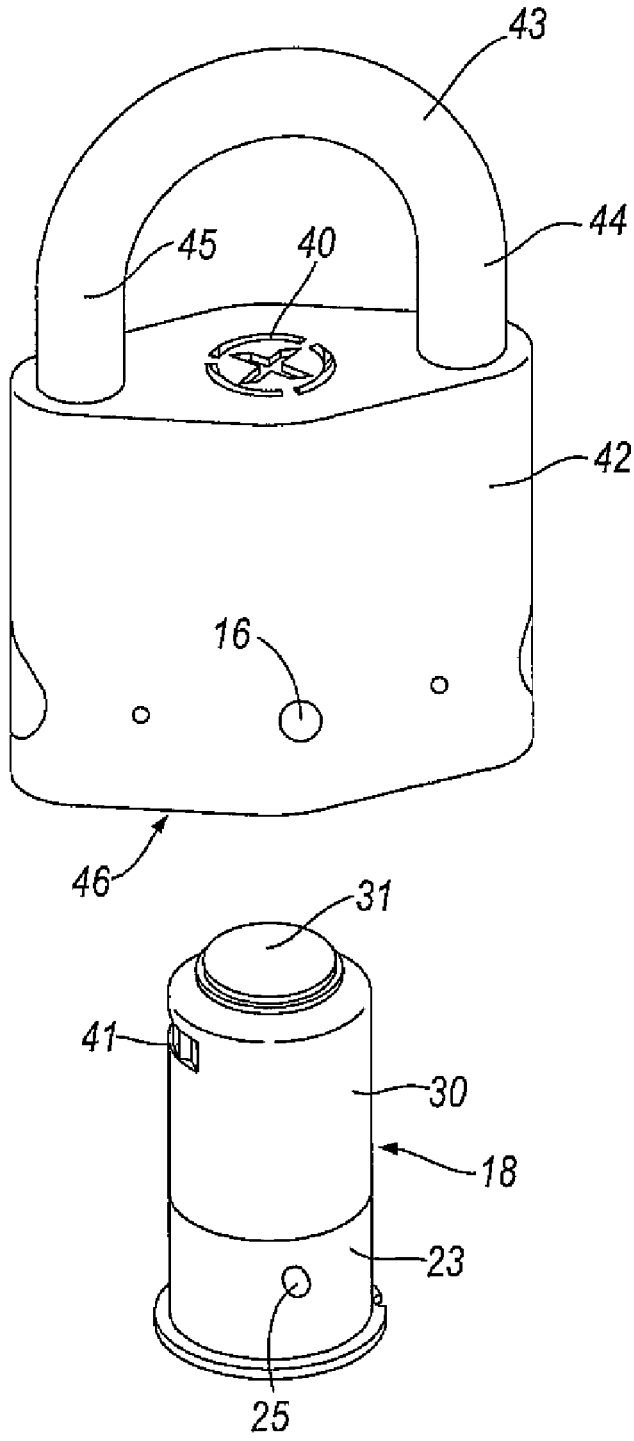
FIG. 4 is a perspective view of a lock according to a second embodiment showing a body of a lock and a unit separated from the body.

Referring next to FIG. 4, the lock shown in this Figure has parts common with the lock of FIGS. 1 to 3. Those parts are not described in detail and are given the same reference numerals in FIG. 4 as they are in FIGS. 1 to 3.

The lock of FIG. 4 is provided with a body 42 having a base generally indicted at 46 and a U-shaped locking member 43 with two arms 44, 45. The free ends of the arms 44, 45 are received within respective passages in the body 42 in a locking position of the locking member 43. In an unlocked position, the locking member 43 can be removed from the body 42 and the arms 44, 45 withdrawn from the respective passages. The body 42 has a bore having a cavity open at one end and closed at the other end, the open end being at the base 46, similar to the bore 15 described above with reference to FIGS. 1 to 3 together with a passage, holes and catches similar to the passage 16, holes 17 and catches 32, 33 described above with reference to FIGS. 1 to 3. The unit 18 is as described above with reference to FIGS. 1 to 3.

In use, the unit 18 is inserted into the bore 15 and the key turned as described above to extend the locking pins 25 so that the locking pins 25 enter the holes 17 to lock the unit 18 to the body 42. At the same time, the locking unit 19 operates the catches 32 to prevent the U-shaped locking member 43 being moved away from the locked position. In this position, the unit closes the bore 15.

As described above, if switched on, the siren 31 will operate if there is an attempt to tamper with the lock.

The key (not shown) can be used to retract the locking pins 25 and the holes 17 and allow the unit 18 to be removed from the body 42. This releases the U-shaped locking member 43 and allows the locking member 43 to be moved from the locked position shown and disengaged from the body 42.

It will be appreciated that, in both the embodiments described above with reference to the drawings, the incorporation of the unit 18 into the body 10, does not compromise the strength of the mechanical lock. At the same time, it facilitates the changing of batteries from the battery compartment 20 and the servicing of the electronics module 21 without the need for an ancillary aperture. The elimination of an access door for changing the batteries 27 also eliminates the need to secure such access to prevent tampering with electronics. It also eliminates the need for additional tools to open any access door.

The use of the unit 18 facilitates easy removal of the entire electronics module for servicing or upgrading.

Further, the separate unit 18 and body 10, 42 allows the modular construction of a range of locks incorporating electronics since many different kinds of lock body can use the same unit 18. The unit can cheaply and efficiently be made waterproof if required. The unit 18 also allows the modular construction of a range of the parts of which the unit 18 itself is constructed—a range of electronics modules 21 and/or locking units 19 may be so constructed. Such a range of locking units would have locking units having locking mechanisms operable with respectively different keys. Accordingly, a lock comprising a unit 18 can have its unit replaced by a replacement unit. A lock can also have its sub-unit replaced by a replacement sub-unit. A lock can also have its locking unit replaced by a replacement locking unit. A unit 18, sub-unit or locking unit 19 can also be used to respectively replace a unit, sub-unit or locking unit in a further lock.

The cost of adding electronics to a locking system is determined solely by the cost of the sub-unit. No adaptation of the body 10, 42 or the locking members 14, 43 is required. The electronics module 21 can be used not only to provide an alarm but also radio transmission, date recording, diagnostic system, sensors, light detectors or gas detectors.

A large range of products can be held in stock by suppliers and distributors for little cost since the bodies 10, 42 can be manufactured at low cost while the unit 18, or the sub-unit and locking unit of which the unit is comprised, can be stored in lower volumes since any unit 18, or sub-unit and locking unit, will fit every body 10, 42.

It will be appreciated there are a number of variations that can be made to the locks described above with reference to the drawings. In the embodiments described above, the locking member 14, 42 is locked on insertion of the unit 18 into the bore 15. This need not be the case. The locking of the locking bolt 14, 42 could be achieved by a first angular rotation of the key with an additional angular rotation then locking the unit 18 to the body 10, 42. Alternatively, rotation of the key in one sense through an angle and back again could lock and unlock the locking bolt 14, 42, rotation of the key in an opposite sense through an angle and back again could lock and unlock the unit 18 from the body 10, 42. In this latter case, the unit 18 would only be removed when servicing was required.

The lock 19 can house any required form of locking mechanism. Although reference has been made above to a key operated locking mechanism, the locking mechanism need not be key operated; it could be electronically operated or operated in any other way.

In the embodiments described above the electronics module 21 has a cylindrical housing 30 provided with a thread for thread engagement with a thread 24 on the locking portion 19. The locking portion 19 and the electronics module 21 need not be connected or connectable. If unconnected, removal of the locking portion from the body would leave the sub-unit in the body; the electronics module could then be serviced and/or the batteries replaced in situ, or removed separately for servicing and/or replacement of batteries. The electronics module and the locking unit also need not be disconnectable—their respective housings could be formed of a single housing. The locking portion and the electronics module also need not be thread connectable—they could be connected, disconnectably or otherwise, by other means.

The invention claimed is:

1. A lock comprising a body, a locking member movable relative to the body into and away from a locked position, a mechanical locking unit engaged with the body and lockable to lock the locking member in the locked position and unlockable to release the locking member for movement away from said locked position, a cavity formed in the body and having first and second ends, the cavity being open at the first end and closed at the second end and a sub-unit located in the cavity towards the closed second end of the cavity, the sub-unit including a power source and a system powered by the source, the locking unit, when engaged with the body closing said cavity between the sub-unit and the said open first end and, when said locking unit is unlocked, being disengageable from the body to permit access to the sub-unit.

2. A lock according to claim 1 wherein the sub-unit is removable from said body after disengagement of the locking unit.

3. A lock according to claim 2 wherein the locking unit and the sub-unit are separately formed, the sub-unit being removable from the body after disengagement of the locking unit.

4. A lock according to claim 1 wherein the locking unit and the sub-unit are connected, the sub-unit being removed from the locking unit on disengagement of the locking unit from the body.

5. A lock according to claim 4 wherein the locking unit and the sub-unit are disconnectable.

6. A lock according to claim 1 wherein the locking unit is received in the cavity within the body.

7. A lock according to claim 1 wherein the cavity has the open end allowing access to the power source and powered system in the cavity when said locking unit is disengaged from the body, engagement of the locking unit closing said end.

8. A lock according to claim 6 wherein the cavity has the open end allowing access to the power source and powered system in the cavity when said locking unit is disengaged from the body, engagement of the locking unit closing said end.

9. A lock according to claim 1 wherein the cavity has the open end allowing access to the sub-unit when said locking unit is disengaged from the body, engagement of said locking unit closing said end to prevent access to the sub-unit.

10. A lock according to claim 1 wherein the locking unit includes a housing, the housing containing a locking mechanism.

11. A lock according to claim 10 wherein the locking unit has a generally cylindrical housing, the cavity including a cylindrical bore receiving the housing.

12. A lock according to claim 10 wherein the locking mechanism is key-operated, the locking unit housing including an aperture for a key, operation of the key in one sense releasing the locking unit for disengagement from the body.

13. A lock according to claim 12 wherein separation of the locking unit from the body releases the locking member.

14. A lock according to claim 13 wherein re-engagement of the locking unit with the body when the locking member is located in the locked position acts to hold the locking member in the locked position, rotation of the key in a sense opposite to said one sense locking the locking unit to the body.

15. A lock according to claim 14 wherein the power source is connected to the locking mechanism and the system is connected to the power source, operation of the key causing operation of the powered system.

16. A lock according to claim 10 wherein the locking mechanism includes at least one locking pin, the or each locking pin being extendable by operation of the locking mechanism to extend the or each pin radially of the housing to engage with the body to lock the locking unit to the body and the or each pin being radially retractable by operation of the locking mechanism to release the locking unit from the body.

17. A lock according to claim 1 wherein the power source comprises at least one battery.

18. A lock according to claim 1 wherein the powered system is a radio transmitter or data logging system or a diagnostic system or a sensor or an alarm.

19. A lock system comprising a lock according to claim 1 and at least one further sub-unit, the sub-unit being replaceable by the or one of said further sub-units.

20. A lock system comprising a lock according to claim 1 and at least one further locking unit, the locking unit being replaceable by the or one of said further locking units.

21. A lock system comprising a lock according to claim 1 and at least one further body, the body being replaceable by the or one of said further bodies.

* * * * *